US011519589B1

(12) United States Patent
Zhang

(10) Patent No.: US 11,519,589 B1
(45) Date of Patent: Dec. 6, 2022

(54) MAGNETIC LED BAR KIT

(71) Applicant: Kanghong Zhang, Santa Fe Springs, CA (US)

(72) Inventor: Kanghong Zhang, Santa Fe Springs, CA (US)

( * ) Notice: Subject to any disclaimer, the term of this patent is extended or adjusted under 35 U.S.C. 154(b) by 0 days.

(21) Appl. No.: 17/742,174

(22) Filed: May 11, 2022

(51) Int. Cl.

| | |
|---|---|
| ***F21V 21/096*** | (2006.01) |
| ***F21S 4/28*** | (2016.01) |
| ***F21V 29/70*** | (2015.01) |
| ***F21V 23/06*** | (2006.01) |
| *F21Y 103/10* | (2016.01) |
| *F21Y 115/10* | (2016.01) |

(52) U.S. Cl.
CPC ..... *F21V 21/096* (2013.01); *F21S 4/28* (2016.01); *F21V 23/06* (2013.01); *F21V 29/70* (2015.01); *F21Y 2103/10* (2016.08); *F21Y 2115/10* (2016.08)

(58) Field of Classification Search
CPC ..... F21V 21/096; F21V 23/06; F21V 29/70; F21S 4/28; F21Y 2103/10; F21Y 2115/10
See application file for complete search history.

(56) References Cited

FOREIGN PATENT DOCUMENTS

| | | | |
|---|---|---|---|
| CN | 207018907 U | * | 2/2018 |
| CN | 208281933 U | * | 12/2018 |
| KR | 1020170135134 | * | 12/2017 |

OTHER PUBLICATIONS

English Translation of CN-207018907-U; Shelf Lamp; Chen (Year: 2018).*
English Translation of KR1020170135134; Device of Mounting Light Source For LED; Kim (Year: 2017).*
InnovationQ+ Discover search results for U.S. Appl. No. 17/742,174, filed Aug. 30, 2022.*
InnovationQPlus search claim 1 of U.S. Appl. No. 17/742,174, filed Oct. 16, 2022 (Year: 2022).*

* cited by examiner

*Primary Examiner* — Jong-Suk (James) Lee
*Assistant Examiner* — Glenn D Zimmerman
(74) *Attorney, Agent, or Firm* — Clement Cheng

(57) ABSTRACT

A magnetic LED bar kit has a lens. The lens is elongated. The frame is elongated, wherein the lens fits over the frame. The anchor includes a right anchor portion and a left anchor portion. The right anchor portion has a right anchor opening. The left anchor portion has a left anchor opening. The right anchor opening and the left anchor opening are vertically oriented. The right anchor portion further includes a right anchor magnet. The left anchor portion further includes a left anchor magnet. A retaining channel is formed on the frame. The retaining channel has a left retainer and a right retainer. An LED board mounted to the retaining channel. The electrical connector is mounted to the LED board at an end of the LED board.

8 Claims, 3 Drawing Sheets

MAGNETIC LED BAR KIT

FIELD OF THE INVENTION

The present invention is in the field of LED lighting.

DISCUSSION OF RELATED ART

LED lighting can provide energy efficient light for indoor or outdoor use. When retrofitting or installing an LED bar into a fixture, the installer needs to hold the bar, pick out screws, and then use a screwdriver to mount the screws to the fixture. This is nearly impossible to do by one person on a ladder. Some LED bars have a magnet on the bottom of the light bar and the magnet will hold the bar in place to free the installer's hands so that the installer can pick out screws to secure the bar to the fixture frame. However, with the magnet on the bottom of the bar, this generates a gap between LED bar in the fixture body where the LED bar cannot use the fixture body to dissipate the heat. This also makes the bar higher so that the fixture cannot be low-profile. When the magnet is on the bottom, it is still hard to adjust the bar because not all fixture bodies are flat right under the magnet. Additionally, the user may need to mount fixtures on the and/or on the side and these configurations don't work for either of those applications. Sometimes, aluminum structures are required to hold the magnets and provide mounting holes as well. Requiring aluminum increases cost.

SUMMARY OF THE INVENTION

A magnet is separated and attached to an LED bar on the sides are on the ends of the LED strip. The LED board and aluminum backing are in contact and can be thermally bridged by conductive paste to achieve superior An object of the present invention is to provide a magnet securing system for an LED light bar.

A magnetic LED bar kit has a lens. The lens is elongated. The frame is elongated, wherein the lens fits over the frame. The anchor includes a right anchor portion and a left anchor portion. The right anchor portion installs to a right anchor channel on the frame, and the left anchor portion installs to a left anchor channel. The right anchor portion has a right anchor opening. The left anchor portion has a left anchor opening. The right anchor opening and the left anchor opening are vertically oriented. The right anchor portion further includes a right anchor magnet. The left anchor portion further includes a left anchor magnet. A retaining channel is formed on the frame. The retaining channel has a left retainer and a right retainer. An LED board mounted to the retaining channel. The electrical connector is mounted to the LED board at an end of the LED board.

The right anchor magnet has a toroidal shape and is aligned concentrically with the right anchor opening. The left anchor magnet has a toroidal shape and is aligned concentrically with the left anchor opening. The right anchor magnet and the left anchor magnet are oriented to have dual function such that they first magnetically attach the frame to a metal substrate, and then retain connectors to allow single-handed installation by a user.

The frame is formed as an extruded metal member having a right lens channel and a left lens channel. The right lens channel receives a right lens protrusion, and the left lens channel receives a left lens protrusion. The right lens protrusion extends horizontally towards the frame in the direction of the left lens protrusion. The left lens protrusion extends horizontally towards the frame in the direction of the right lens protrusion. The lens includes a downwardly extending right lens leg and a downwardly extending left lens leg. The right lens protrusion is formed on the right lens leg. The left lens protrusion is formed on the left lens leg.

The right retainer is formed as the right retaining ridge and the left retainer is formed as the left retaining ridge. The retainers are configured to dissipate heat as supplemental heat fins. The LED board is formed as a circuit board with LED chips installed thereon. The electrical connector is mounted to the circuit board end. A thermal paste is designed to thermally bridge the circuit board to the frame. The second right anchor, a second left anchor and a second electrical connector can be mounted opposite to the right anchor, the left anchor, and the electrical connector.

The frame preferably has pair of elongated channels on the left and right sides of the frame. The left anchor channel and the right anchor channel are one of the pair of elongated channels. The pair of elongated channels define three horizontally extending fins on each side of the frame that have dual function which is a heat dissipation function as well as a structural function. The right lens channel is formed between the upper right fin and the middle right fin. The left lens channel is formed between the upper left fin and the middle left fin. The right anchor protrusion is received between the right middle fin and the lower right fin. The left anchor channel is formed between the middle left fin and the lower left fin and receives the left anchor protrusion. The protrusions are formed with engaging edges as round knobs that engage rounded hollows of the channels.

Figure 1:
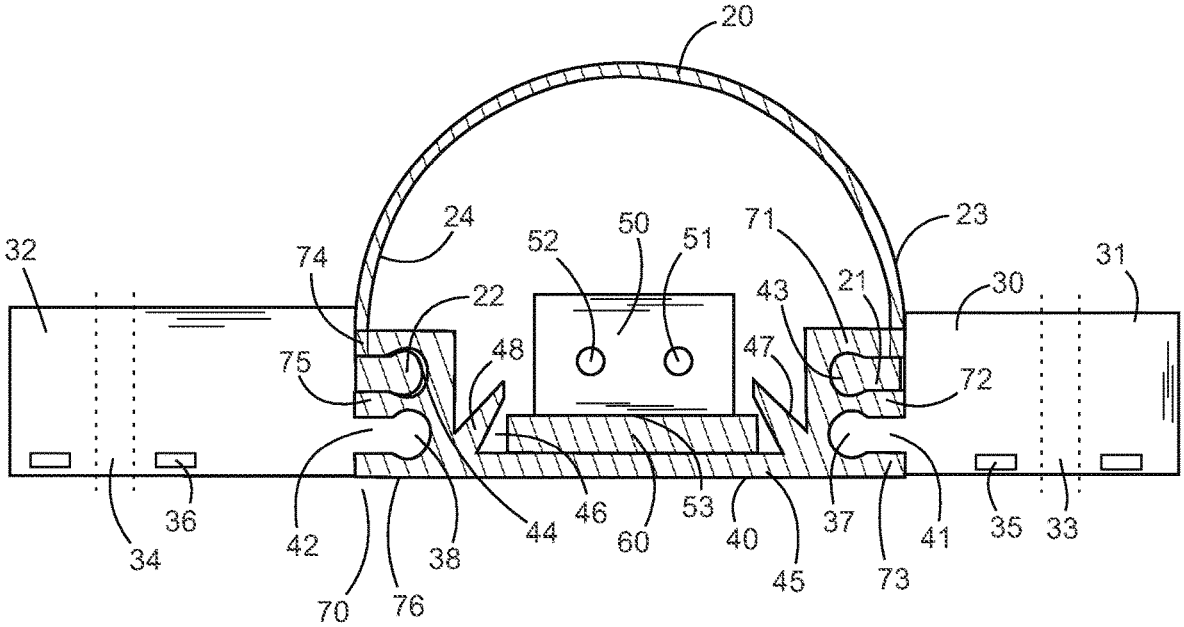
FIG. 1 shows a cross section view of the magnetic LED bar kit.

The following callout list of elements can be a useful guide in referencing the element numbers of the drawings.

20 lens
21 right lens protrusion
22 left lens protrusion
23 right lens leg
24 left lens leg
30 anchor
31 right anchor
32 left anchor
33 right anchor opening
34 left anchor opening
35 right anchor magnet
36 left anchor magnet
37 right anchor protrusion
38 left anchor protrusion
40 frame
41 right anchor channel
42 left anchor channel
45 frame mounting surface
46 retaining channel
47 right retaining ridge
48 left retaining ridge
50 electrical connector
51 right contact
52 left contact
55 second right anchor
56 second left anchor
57 second electrical connector

60 LED board
61 LED chip
62 PCB
63 PCB end
64 thermal paste
70 fins
71 upper right fin
72 middle right fin
73 lower right fin
74 upper left fin
75 middle left fin
76 lower left fin

DETAILED DESCRIPTION OF THE PREFERRED EMBODIMENT

As seen in FIG. 1, the lens 20 can be formed as an extruded dome shape that fits over the frame 40. The frame 40 can be made as an extruded aluminum or metal member having a right lens channel 43 and a left lens channel 44. The right lens channel 43 receives the right lens protrusion 21, and the left lens channel 44 receives the left lens protrusion 22. The right lens protrusion 21 is formed to the right lens leg 23, and the left lens protrusion 22 is formed to the left lens leg 24. The right lens protrusion 21 and the left lens protrusion 22 are elongated along the length of the lens 20 and insert horizontally into the right lens channel 43 and the left lens channel 44 respectively. The right lens protrusion 21 and the left lens protrusion 22 can be oriented towards each other and horizontally such that they are parallel at approximately 180 degrees from each other when the extruded dome shape is a circular shape.

The anchor 30 includes a right anchor portion 31 and a left anchor portion 32 which can be plastic injection molded members that are injection molded over rare-earth element toroidal magnets. Optionally, the anchor 30 can include multiple right and left anchor portions that attach horizontally to the frame 40 at the anchor retaining channels which include the right anchor channel 41 and the left anchor channel 42. The right anchor channel 41 and the left anchor channel 42 are formed below the right lens channel 43 and the left lens channel 44. Optionally, the right anchor channel can be formed in the same shape as the right lens channel so that the anchor 30 can be mounted in either the right lens channel or the right anchor channel depending upon a preferred height of installation of the device. Additionally, the anchor 30 can be reversed for reverse mounting in either channel when both channels are congruent to each other.

The right anchor 31 has a right anchor opening 33, and the left anchor 32 has a left anchor opening 34. The right anchor 31 preferably includes a right anchor magnet 35, and the left anchor 32 preferably includes a left anchor magnet 36. The right anchor magnet 35 and the left anchor magnet 36 can have a toroidal shape with an opening that is aligned concentrically with the right anchor opening 33 and the left anchor opening 34. The right anchor magnet 35 and the left anchor magnet 36 are oriented to have dual function such that they first magnetically attach the frame 40 to a metal substrate such as an iron or steel substrate, and then retain the tips of screws so that a user can single-handedly drive the tips of the screws into the substrate. If a user is using a ladder, the user can place the tips of the screws in the openings before ascending the ladder.

The LED board 60 fits to the frame 40 in the retaining channel 46. The retaining channel 46 is formed between the right retainer formed as the right retaining ridge 47 and the left retainer formed as the left retaining ridge 48. The retainers are preferably formed as ridges to dissipate heat. The frame mounting surface 45 is the lower surface of the frame 40 and contacts the substrate. The substrate can be a metal housing of an existing light fixture. The electrical connector 50 has a right contact 51 and a left contact 52. The electrical connector 50 mounts to the LED board 60 at the electrical connector mounting 53 which is a lower portion of the electrical connector 50.

The frame has a pair of elongated channels on the left and right sides of the frame. The pair of elongated channels define three horizontally extending fins on each side of the frame. The channels and fins have dual function which is a heat dissipation function as well as a structural function. The right lens channel 43 is formed between the upper right fin 71 and the middle right fin 72. The left lens channel 44 is formed between the upper left fin 74 and the middle left fin 75. The right anchor protrusion 37 is received between the right middle fin 72 and the lower right fin 73. The left anchor channel 42 is formed between the middle left fin 75 and the lower left fin 76 and receives the left anchor protrusion 38. Thus, the frame preferably has three horizontally extending fins on each side. The protrusions can be formed with engaging edges as round knobs that engage rounded hollows of the channels. The rounded knob protrusions of elastomeric materials such as plastic injection molded plastic can be resiliently deformed to be press fit into the channels, or the rounded knob protrusions can slide in from an end of the frame 44 sliding installation.

Figure 2:
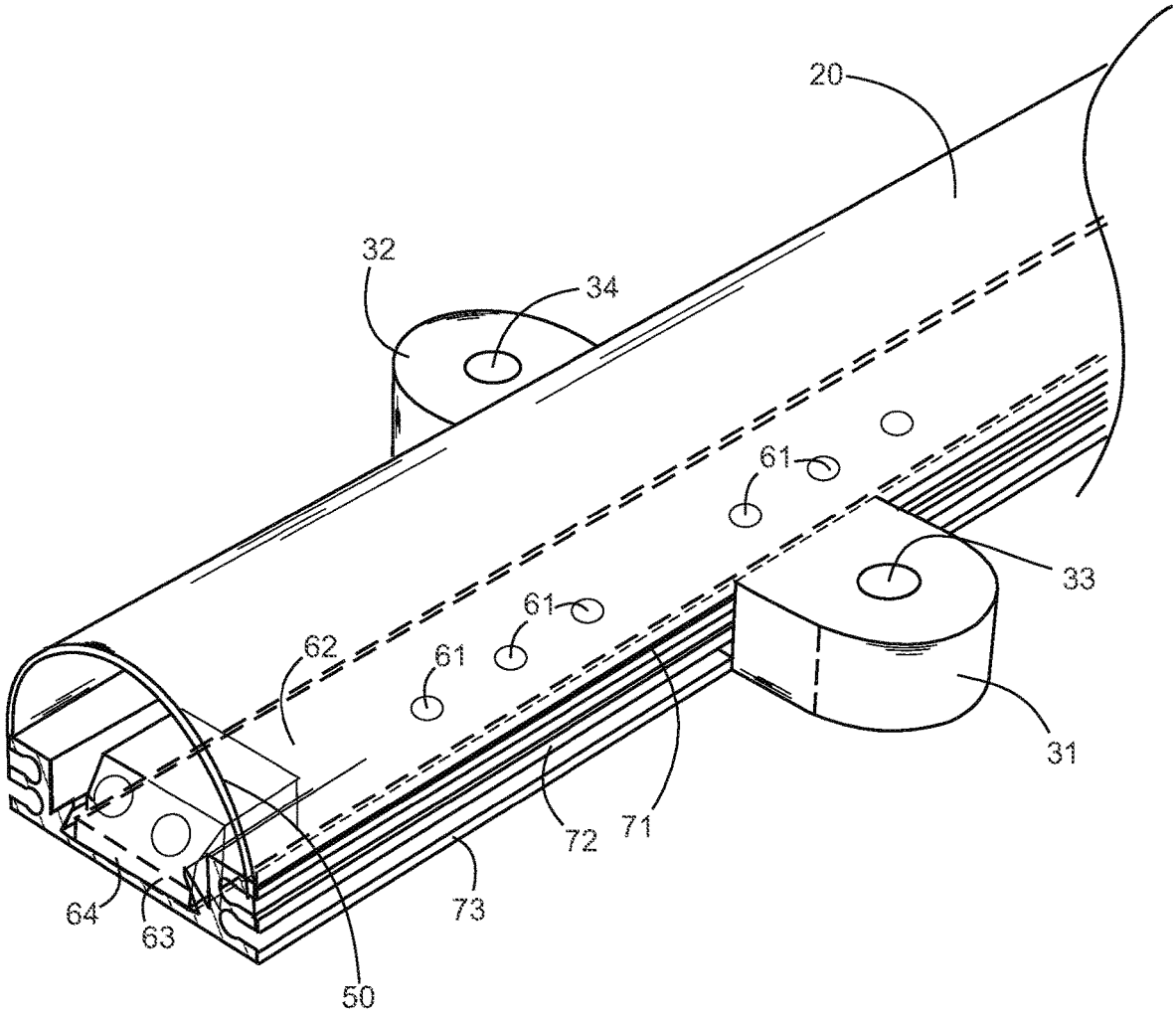
FIG. 2 shows a perspective view of an end of the magnetic LED bar kit.

As seen in FIG. 2, the LED board 60 can be formed as a printed circuit board 62 with numerous LED chips 61 installed thereon. The printed circuit board 62 can also receive the electrical connector 50 at a printed circuit board end 63. Thermal paste 64 can thermal bridge the printed circuit board 62 of the LED board 60 to the frame 40.

Figure 3:
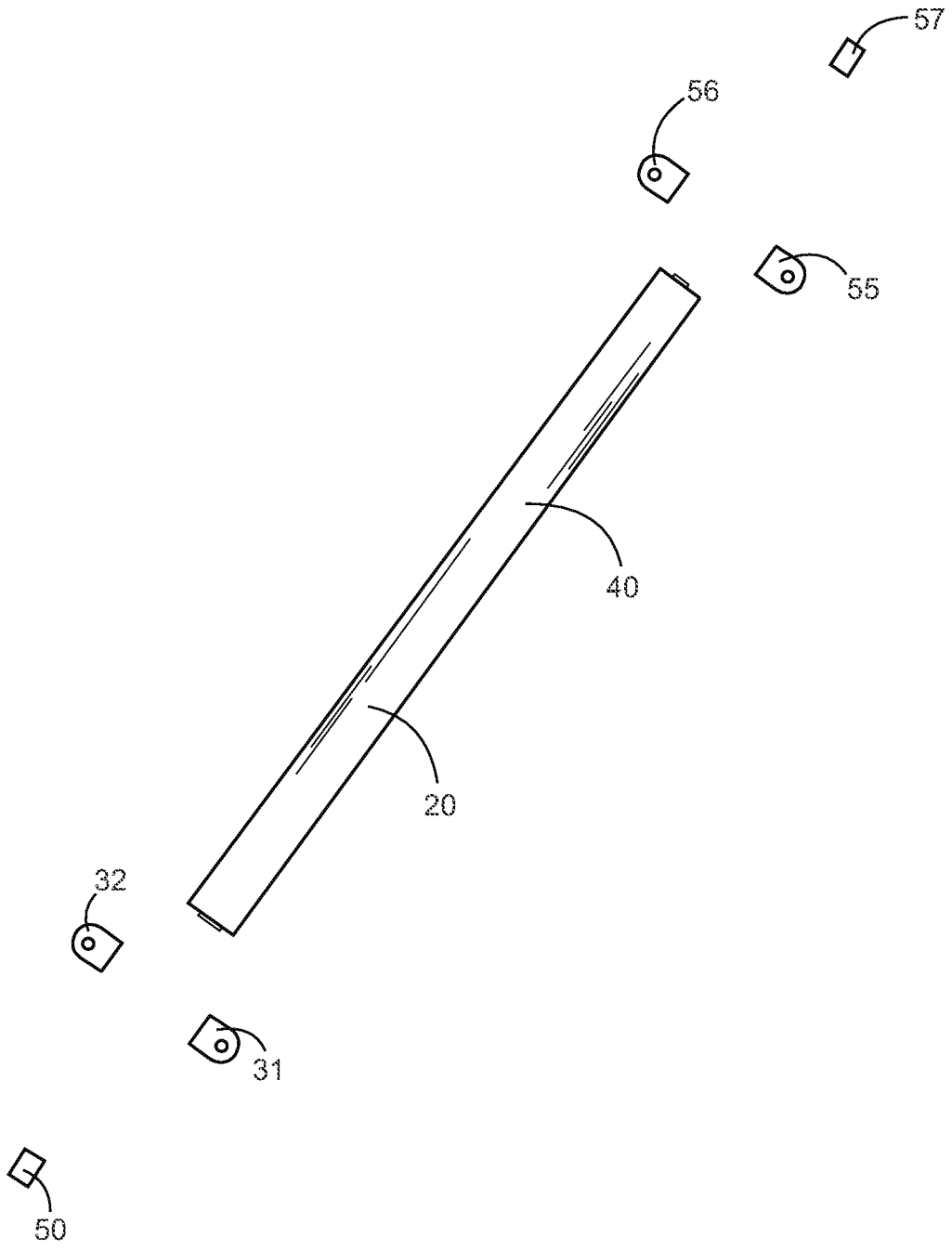
FIG. 3 shows an exploded view of the present invention.

As seen in FIG. 3, the exploded view shows use of a second right angle 55, a second left anchor 56 and a second electrical connector 57 located opposite to the right anchor 31, the left anchor 32, and the electrical connector 50.

The anchors can be installed on both ends of the LED bar when the LED bar is formed with anchor channels that extend around the entire periphery of the LED bar. Although the preferred embodiment is to have an anchor construction with around magnet with the center hole for the screw, the screw is optional when the magnet is strong enough. Also, other shapes of magnets such as bar magnets and the like can be used instead of a toroidal magnet. The screw can be set to the side of the magnet instead of through the magnet. For example, the screw can be set in a screw opening that is formed on an edge of the magnet still through the plastic foot. The screw hole could be formed on an aluminum body extrusion with the magnet being removable for reuse in installing other LED light bars. For example, the screws can be put through screw openings in the LED bar such as directly through the frame 40. The anchors can slide in the rails and are thus removable and optionally reusable. This allows a lower profile installation where necessary in some locations.

The invention claimed is:

1. A magnetic LED bar kit comprising:

a. a lens, wherein the lens is elongated;

b. a frame, wherein the frame is elongated, wherein the lens fits over the frame, wherein the frame further includes a right anchor channel and a left anchor channel;

c. an anchor, wherein the anchor includes a right anchor portion and a left anchor portion, wherein the right anchor portion installs to the right anchor channel, and wherein the left anchor portion installs to the left anchor channel, wherein the right anchor portion has a right anchor opening, and wherein the left anchor portion has a left anchor opening, wherein the right anchor opening and the left anchor opening are vertically oriented, wherein the right anchor portion further includes a right anchor magnet, wherein the left anchor portion further includes a left anchor magnet;

d. a retaining channel formed on the frame, wherein the retaining channel comprises a left retainer and a right retainer;

e. an LED board mounted to the retaining channel; and f. an electrical connector, wherein the electrical connector is mounted to the LED board at an end of the LED board.

2. The magnetic LED bar kit of claim 1, wherein the right anchor magnet has a toroidal shape and is aligned concentrically with the right anchor opening, wherein the left anchor magnet has a toroidal shape and is aligned concentrically with the left anchor opening, wherein the right anchor magnet and the left anchor magnet are oriented to have dual function such that they first magnetically attach the frame to a metal substrate, and then retain connectors to allow single-handed installation by a user.

3. The magnetic LED bar kit of claim 1, wherein the frame is formed as an extruded metal member having a right lens channel and a left lens channel, wherein the right lens channel receives a right lens protrusion, and the left lens channel receives a left lens protrusion, wherein the right lens protrusion extends horizontally towards the frame in the direction of the left lens protrusion, and wherein the left lens protrusion extends horizontally towards the frame in the direction of the right lens protrusion, wherein the lens includes a downwardly extending right lens leg and a downwardly extending left lens leg, wherein the right lens protrusion is formed on the right lens leg, and wherein the left lens protrusion is formed on the left lens leg.

4. The magnetic LED bar kit of claim 1, wherein the right retainer is formed as a right retaining ridge and the left retainer is formed as a left retaining ridge, wherein the right retaining ridge and the left retaining ridge are both configured to dissipate heat as supplemental heat fins.

5. The magnetic LED bar kit of claim 1, wherein the LED board is formed as a circuit board with LED chips installed thereon, wherein the electrical connector is mounted to the circuit board end, and further including thermal paste that thermally bridges the circuit board to the frame.

6. The magnetic LED bar kit of claim 1, further including a second right anchor, a second left anchor and a second electrical connector located opposite to the right anchor, the left anchor, and the electrical connector.

7. The magnetic LED bar kit of claim 1, wherein the frame further includes two pairs of elongated channels on the left and right sides of the frame, wherein the right anchor channel and the left anchor channel comprises one of the pair of elongated channels, wherein the pair of elongated channels define three horizontally extending fins on each side of the frame that have dual function which is a heat dissipation function as well as a structural function, wherein a right lens channel is formed between an upper right fin and a middle right fin, wherein a left lens channel is formed between an upper left fin and a middle left fin, wherein the right anchor protrusion is received between the right middle fin and a lower right fin, wherein the left anchor channel is formed between the middle left fin and a lower left fin and receives the left anchor protrusion.

8. The magnetic LED bar kit of claim 7, wherein the protrusions are formed with engaging edges as round knobs that engage rounded hollows of the channels.

* * * * *